US008701315B2

(12) United States Patent
Glass et al.

(10) Patent No.: US 8,701,315 B2
(45) Date of Patent: Apr. 22, 2014

(54) REDUCED PROFILE GIFT CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/293,091

(22) Filed: Nov. 9, 2011

(65) Prior Publication Data

US 2012/0285055 A1 Nov. 15, 2012

Related U.S. Application Data

(60) Provisional application No. 61/411,916, filed on Nov. 9, 2010.

(51) Int. Cl.
*G09F 1/00* (2006.01)

(52) U.S. Cl.
USPC ..... 40/124.06; 40/124.09; 206/768

(58) Field of Classification Search
USPC ..... 40/124.06, 124.09, 124.11; 206/767, 206/768; 229/92.8
See application file for complete search history.

(56) References Cited

U.S. PATENT DOCUMENTS

| | | | | |
|---|---|---|---|---|
| 6,877,263 | B2 * | 4/2005 | Clark | 40/124.06 |
| 2006/0101678 | A1 * | 5/2006 | Wilen | 40/124.06 |
| 2008/0034624 | A1 * | 2/2008 | Bardolph et al. | 40/124.06 |
| 2008/0149727 | A1 * | 6/2008 | Boyd et al. | 235/487 |
| 2010/0011634 | A1 * | 1/2010 | Dweck et al. | 40/124.06 |
| 2011/0180608 | A1 * | 7/2011 | Cameron et al. | 235/492 |

* cited by examiner

*Primary Examiner* — Kristina Junge
(74) *Attorney, Agent, or Firm* — Polsinelli PC

(57) ABSTRACT

A reduced profile gift card holder includes a pocket for storing a gift card and a tear away panel for holding a gift card prior to purchase, yet is dimensioned so that one or more of such holders may be presented for sale in prior art display boxes designed to hold only gift cards. The holder may include enhancement elements such as graphics and text upon the holder surfaces and pop-up elements that move and stand off from the surfaces of the holder when the holder is opened.

13 Claims, 5 Drawing Sheets

Prior Art

REDUCED PROFILE GIFT CARD HOLDER

CROSS REFERENCE TO RELATED APPLICATIONS

This application claims the benefit of the prior filed, provisional application Ser. No. 61/411,916, filed Nov. 9, 2010.

BACKGROUND OF THE INVENTION

This invention relates generally to gift card holders and more particularly to a device for holding a gift card while providing graphical and mechanical enhancements to entertain the gift card recipient and add value to the gift, namely pop-up elements, a pocket for storing a gift card, and a tear away panel for holding a gift card prior to purchase.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or may be selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient. Gift cards are often presented for sale on display racks in stores, sometimes in plastic or acetate boxes mounted on display stands. The boxes are typically sized to have a width only slightly greater than the longitudinal width of a gift card and to have a depth sufficient to hold several gift cards stacked one behind the other.

What is needed, therefore, is a gift card holder that provides graphical and mechanical enhancements to entertain the gift card recipient and add value to the gift, and which also has dimensions similar to that of a gift card so that one or more of such holders may be presented for sale in prior art display boxes designed to hold gift cards.

BRIEF DESCRIPTION OF THE INVENTION

The purpose of this invention is to provide a holder for receiving and holding a gift card. An embodiment of the holder includes a slot leading to a pocket in a front holder flap. The slot and pocket are sized for receiving a gift card. The front holder flap is hingedly connected along its back edge to a parallel back edge of a middle holder flap, the front and middle flaps thereby forming a common back edge. Typically, the middle flap is of the same width as the front flap but also of increased height. The front edge of the middle flap typically extends beyond the front edge of the front flap and includes a tab that captures a proximate portion of the front flap front edge to thereby hold the front flap to the middle flap in a closed disposition. A back holder flap is glued at the back edge thereof to a portion of the underside of the middle flap. The back holder flap may comprise a tear away flap that is hingedly connected along a top, back edge thereof to a portion of the middle flap. A line of perforations extends along the back edge of the tear away flap parallel to the back edge of the back flap and in relatively close proximity thereto. The front flap comprises two aligned panels connected to one another along parallel edges to form a pocket sized to receive and hold a card.

The holder may include one or more further enhancement elements such as graphics and text upon the holder surfaces and pop-up elements that move and stand off from the surfaces of the holder when the holder is opened.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
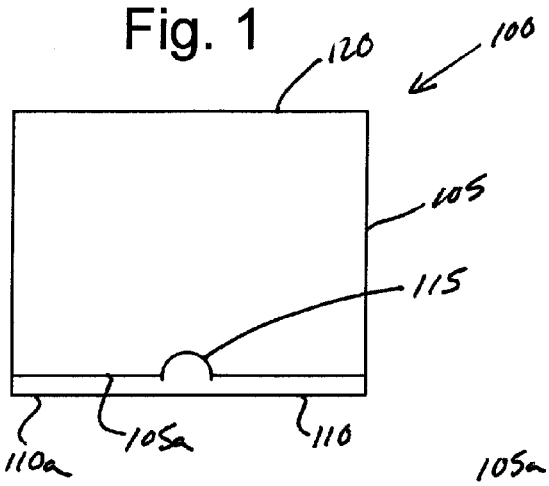
FIG. 1 is a front view of a reduced profile gift card holder with the front holder flap secured in a closed position against the middle holder flap by the closure tab.

With reference to the figures, FIG. 1 is an illustration of a reduced profile gift card holder 100 with the front holder flap 105 secured in a closed position against the middle holder flap 110 by the closure tab 115. The front flap 105 is hingedly connected to the middle flap 110 along the top, back edge 120 of the holder 100. The middle flap 110 is of typically the same longitudinal length as the front flap 105 but also of typically increased transverse width (height) such that the front, bottom edge 110*a* of the middle flap 110 typically extends beyond the front, bottom edge 105*a* of the front flap 105. The front, bottom portion of the middle flap 100 includes the tab 115 which captures a proximate portion of edge 105*a* to thereby hold the front flap 105 to the middle flap 110 in a closed disposition.

A back holder flap 130 is hingedly connected to the front and middle flaps 105, 110 along the top, back edge 120 of the holder 100. The back flap 130 may comprise a subunit tear away flap 135 that is defined or set apart from the rest of the back flap 130 by a line of perforations 140 that extends transversely along the back flap 130 parallel to the back edge 120, and spaced apart from the back edge 120 while in relatively close proximity thereto.

The front flap 105 typically comprises two thicknesses of cardstock or similar material (subpanels 106 and 107, see FIGS. 4 through 7) that are adhered or otherwise attached together around three of the four panel margins to form an enclosure or pocket 150 with an open side or slot 145. The slot 145 and pocket 150 are dimensioned to receive a gift card 155, which is inserted into the pocket 150 prior to giving the gift card 155 and holder 100 to a recipient. A finger notch 151 in one of the front flap 105 subpanels (panel 106, as illustrated) provides a space for a user's finger to contact a surface of the gift card 155 when it is held within the front flap 105 pocket 145.

Figure 2:
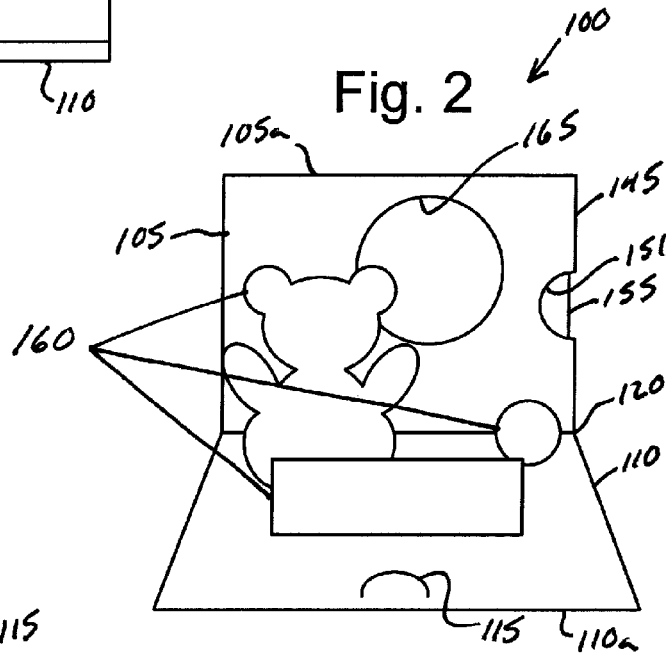
FIG. 2 is a view of the holder with the front flap opened to reveal the interior of the holder including the middle flap, pop-up elements, and a gift card installed within the pocket and viewable through a pocket window.

The holder 100 may include one or more further enhancement elements such as graphics and text upon the holder surfaces and pop-up elements 160 that move and stand off from the surfaces of the holder 100 when the holder 100 is opened. FIG. 2 is a view of the holder 100 with the front flap 105 opened to reveal the interior of the holder 100 including the middle flap 110, pop-up elements 160, and a gift card 155 installed within the pocket 150 and viewable through a pocket window 165. Pop-up elements 160 attach to the middle flap 110 and some instances bridge to the front flap 105. Pop-up elements 160 may take any desired and operable shapes and dimensions. The pop-up elements 160 are constructed to fold upon the closure of the holder 100 and to substantially project away from the planes of the front 105 and middle 110 flaps upon opening the holder 100.

Figure 3:
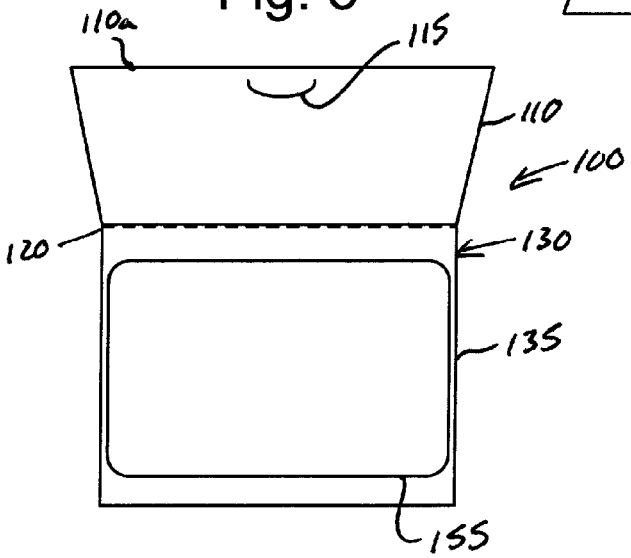
FIG. 3 is a front view of the holder with the front and middle flaps opened to reveal a gift card removably attached to the front surface of the back, tear-away flap.

FIG. 3 is a front view of the holder 100 with the front 105 and middle 110 flaps opened to reveal a gift card 155 removably attached to the front surface of the back flap 130 or, as shown, the tear-away flap 135.

Figure 4:
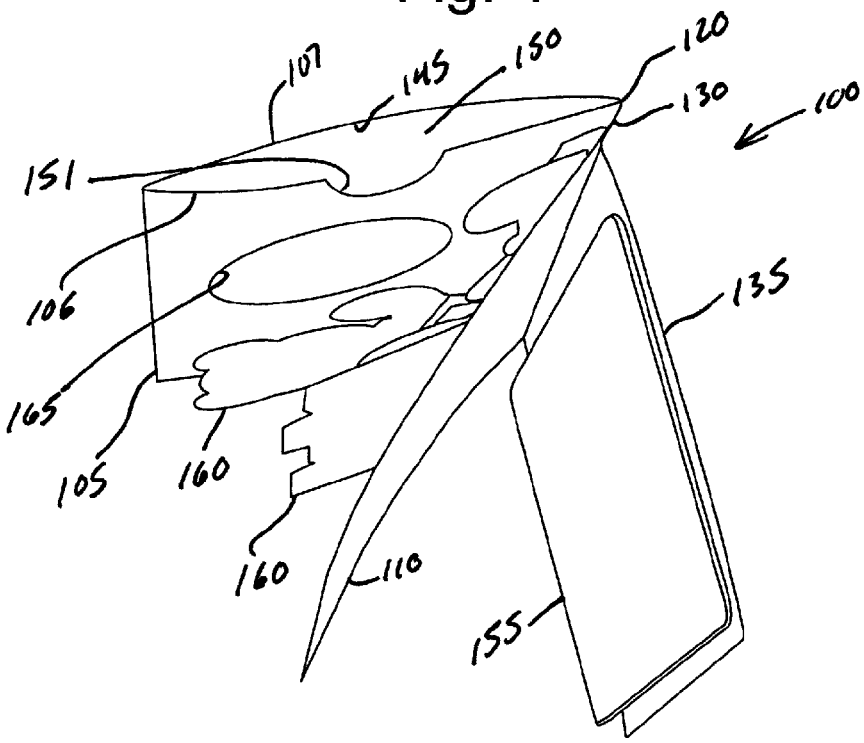
FIG. 4 is substantially a side view of the holder with the front and middle flaps partially opened to reveal the interior of the holder including the pop-up elements and the gift card attached to the front surface of the tear-away flap.
Figure 5:
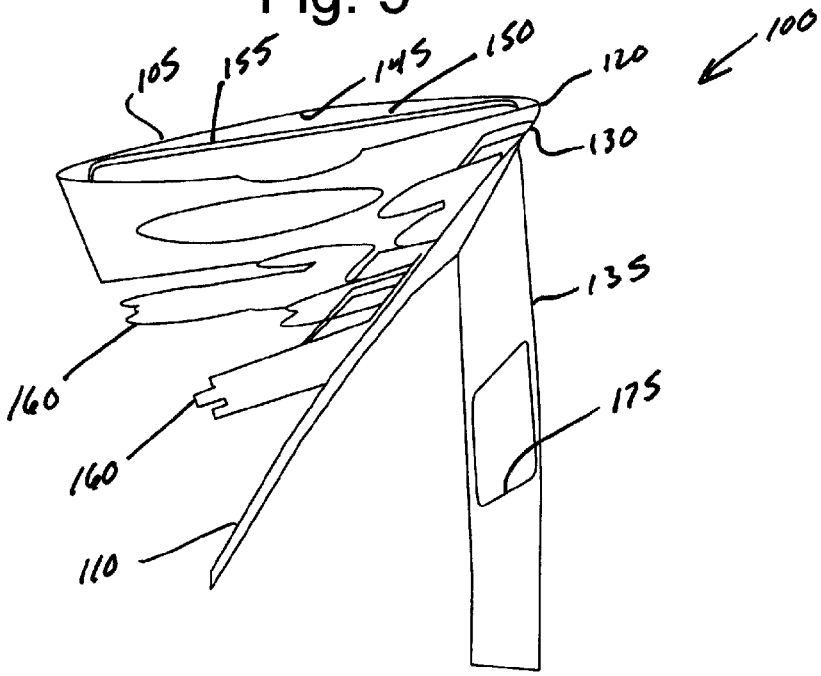
FIG. 5 is substantially a side view of the holder, similar to the view presented in FIG. 4, but with the gift card removed from the tear-away flap and installed within the pocket.

FIG. 4 is an illustration of the holder 100 viewed substantially from the right side thereof. This view shows the front 105 and middle 110 flaps partially opened to reveal the interior of the holder 100 including the pop-up elements 160 and the gift card 155 attached to the front surface of the tear-away flap 135. FIG. 5 is also a side view of the holder 100, similar to the view presented in FIG. 4, but with the gift card 155 removed from the tear-away flap 135 and installed within the pocket 145.

Figure 6:
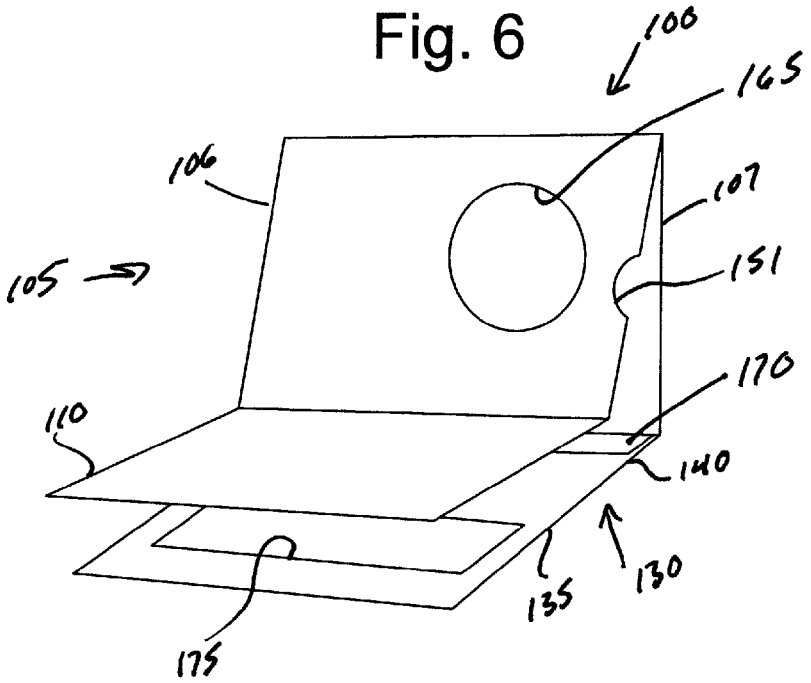
FIG. 6 is an isometric, diagrammatic view of a holder showing the glue strip which adheres the back flap to the middle flap thereby leaving the area below the glue strip unglued and forming the tear-away flap.
Figure 8:
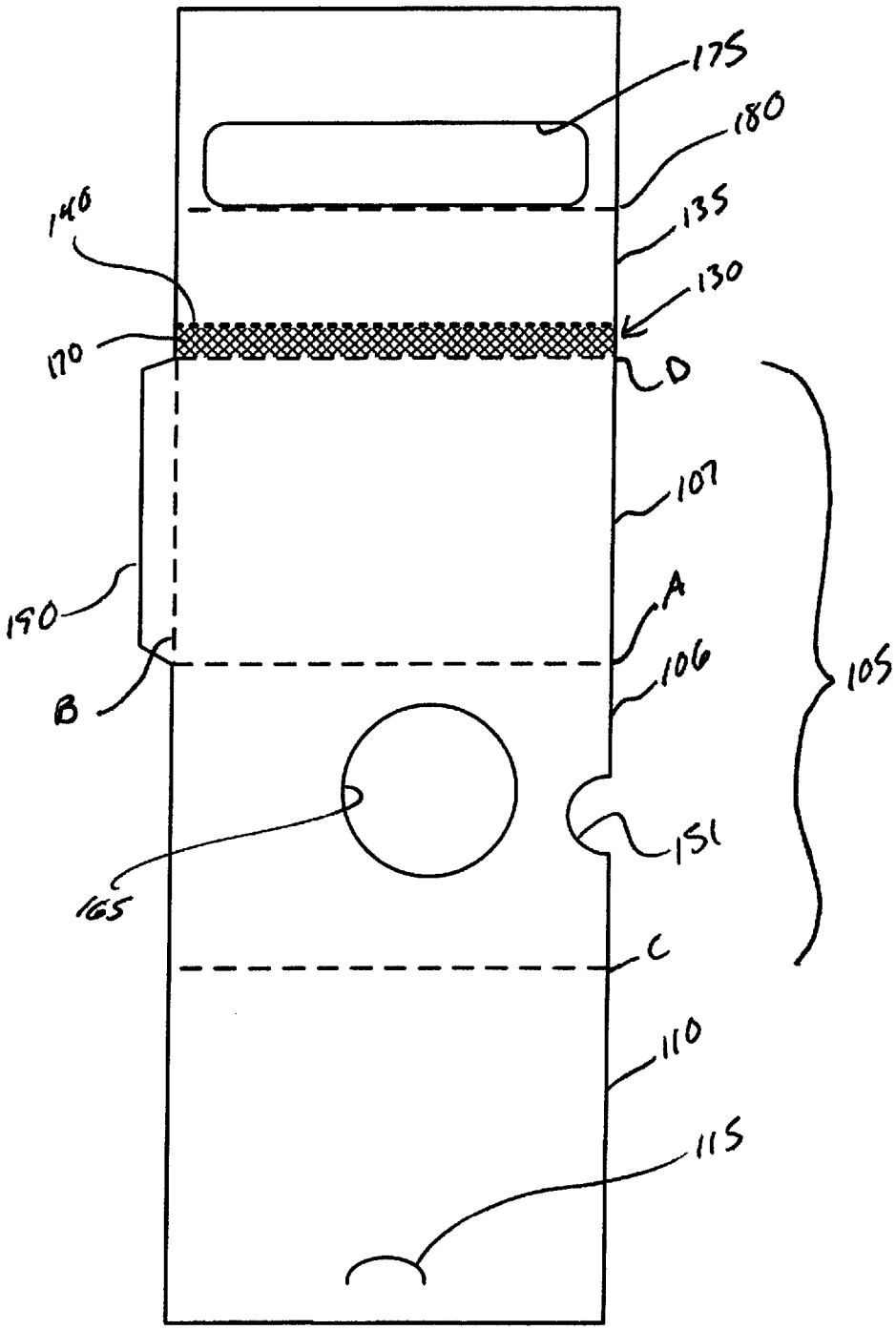
FIG. 8 is a view of die-cut sheet of heavy paper or cardstock which may be folded to assemble a holder.

FIG. 6 is an isometric, diagrammatic view of a holder 100 showing the glue strip 170 which adheres the back flap 130 to the middle flap 110 thereby leaving the area below the glue strip 170 unglued and forming the tear-away flap 135. As shown in FIGS. 5, 6 and 8, the back flap 130 may include an aperture or window 175 sized to allow a barcode or other indicia on the back of the gift card 155 to be viewed and accessed for scanning.

Figure 7:
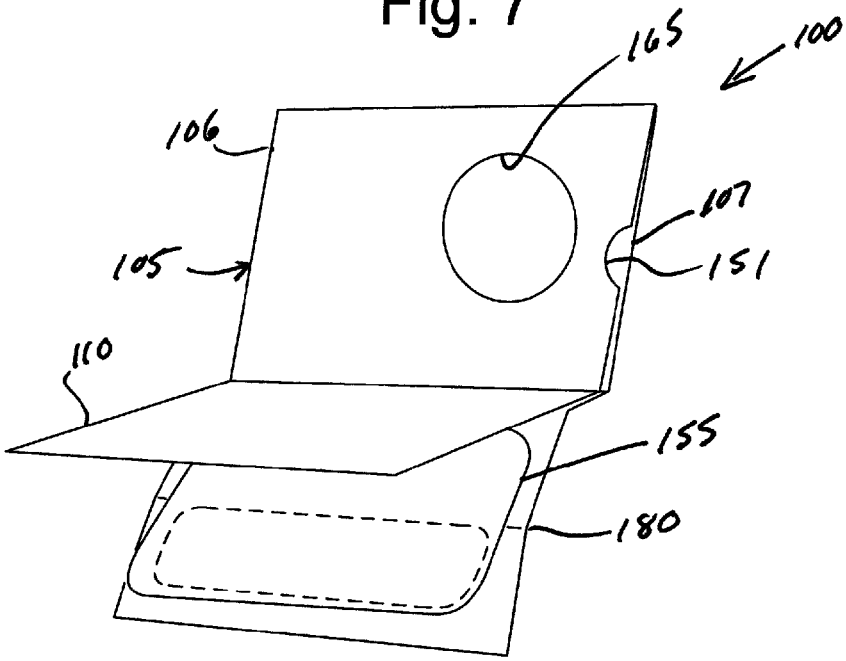
FIG. 7 is an isometric, diagrammatic view of the holder shown in FIG. 6 with the back flap attached to the middle flap via the glue strip, and also showing a gift card temporarily adhered to the front surface of the tear-away flap.

FIG. 7 is an isometric view of the holder 100 shown in FIG. 6 with the back flap 130 attached to the middle flap 110 via the glue strip 170, and also showing a gift card 155 temporarily adhered to the front surface of the tear-away flap 135. As shown in FIG. 7, a fold line 180 may be provided in the back flap 130 to locate and assist in folding a lower portion of the back flap 130 away from a mounted gift card 155 to expose a magnetic strip (not shown) or other indicia for scanning or swiping.

FIG. 8 is a view of die-cut sheet of heavy paper or cardstock which may be folded to assemble a holder 100. For convenience, the holder panels 130, 107, 106, and 110 may be formed from one piece of material that is cut and folded along hinge or fold lines A, B, C and D to form the holder 100 structure. The sheet comprises four major panels: two panels, on either end, that correspond to the back flap 130 and the middle flap 110, and two panels 106 and 107 in the center portion of the sheet that are folded together along fold line A to form the front flap 105 and also to form the enclosure of the pocket 145.

A narrow closure flap 190 projects from panel 107 and is folded over along fold line B so that an inner surface thereof is adjacent an inner surface of panel 107. Panel 106 is then folded along fold line A to rest upon flap 190 and panel 107 so that a portion of an inner surface of panel 106 contacts the outer surface of flap 190. Glue, double-stick tape or other appropriate adhesive placed therebetween secure panel 106 to flap 190 to close the left side of the front flap 105. When folding panel 106 upon panel 107, middle flap 110 is also folded upon back flap 130 so that fold lines C and D meet each other in parallel alignment. A portion of middle flap 110 is secured to back flap 130 via an adhesive strip 170 (indicated by shading) which may comprise glue, double-stick tape or any other appropriate adhesive, thereby forming, when assembled, an enclosed pocket 145 with gift card 155 ingress and egress limited to the slot 150.

Figure 9:
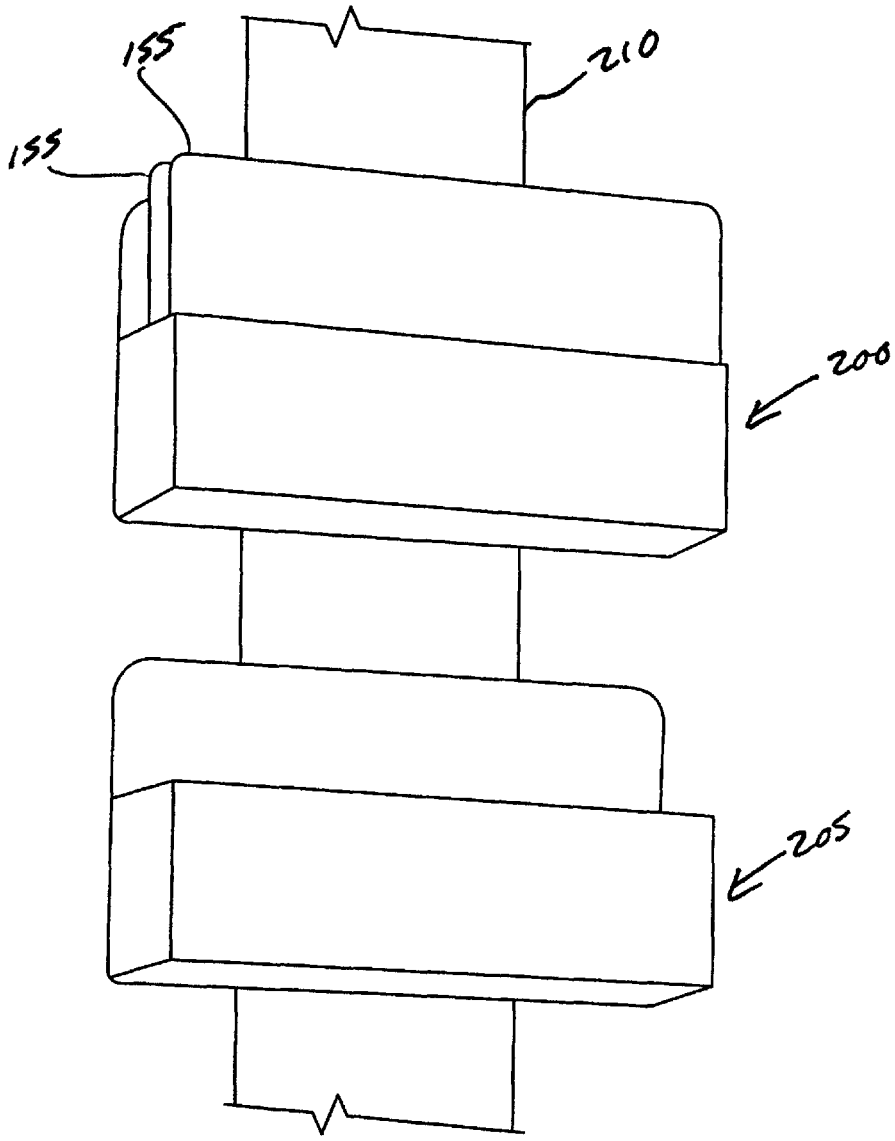
FIG. 9 is a perspective view of devices in the prior art including a first display box mounted on a display rack and holding two gift cards, as well as a second, empty display box located below the first display box.

FIG. 9 is a perspective view of a first display box 200 mounted on a display rack 210 and holding two gift cards 155. A second, empty display box 205 is shown located below the first display box 200. One objective of the present invention is to provide a gift card holder 100 that may also be displayed for sale in such display boxes as used in the prior art. This is achieved, in part, by providing a holder 100 with a profile (principally height and length, but in some embodiments also thickness) similar to that of a gift card 155 while adding substantially to the value of the gift and quality of the gifting experience for the consumer, both gift giver and gift recipient.

Note that drawings are not to scale or to relative scale but are representative of aspects of one or more embodiments of the present invention.

Having thus described the invention, what is claimed as new and desired to be secured by Letters Patent is:

1. A card holder comprising:

a front flap hingedly connected to a middle flap along a common back edge; and a back flap hingedly connected to the middle flap along the back edge of the middle flap, the back flap comprising a tear-away flap defined from the portion of the back flap proximate the back edge by a line of perforations that is parallel to the common back edge of the front flap and the middle flap, wherein the front flap comprising two aligned panels connected to one another along parallel edges to form a pocket sized to receive and hold a card, one of the panels forming an outer surface of the card holder when the card holder is closed.

2. The card holder of claim 1 further comprising an aperture in the back flap to allow a barcode or other indicia on the card to be viewed or accessed when attached to the back flap.

3. The card holder of claim 1 further comprising pop-up elements that move from surfaces of the holder when the holder is opened.

4. The card holder of claim 1, wherein the front flap, middle flap, and back flap are formed from a single piece of material.

5. The card holder of claim 4, wherein the piece of material comprises as least one of heavy paper or cardstock.

6. The card holder of claim 1, further comprising a glue strip extending along the back edge for the middle flap for attaching the middle flap to the back flap.

7. The card holder of claim 1, wherein the card comprises a transaction card.

8. The card holder of claim 7, wherein the transaction card comprises a gift card.

9. The card holder of claim 1, further comprising a packet window formed in one of the panels of the front flap, for viewing the card when inserted in the pocket.

10. The card holder of claim 1, further comprising a tab configured in the front flap for holding the middle flap in a closed position adjacent the front flap.

11. A card holder comprising:

a front flap comprising two aligned panels connected to one another along parallel edges to form a pocket sized to receive and hold a stored value card;

a middle flap having a back edge that is hingedly coupled to a back edge of the front flap;

a back flap hingedly connected to the middle flap along the back edge of the middle flap, the back flap comprising a tear-away flap defined from the portion of the back flap proximate the back edge by a line of perforations that is parallel to the common back edge of the front flap and the middle flap, wherein one of the panels of the front flap forms an outer surface of the card holder when the card holder is closed.

12. The card holder of claim 11, wherein the front flap, middle flap, and back flap are formed from a single piece of material.

13. The card holder of claim 11, wherein the stored value card comprises a gift card.

* * * * *